US006144355A

United States Patent [19]

Murata et al.

[11] Patent Number: 6,144,355

[45] Date of Patent: Nov. 7, 2000

[54] DISPLAY DEVICE INCLUDING A PHASE ADJUSTER

[75] Inventors: Hiroyoshi Murata; Hirofumi Kato; Kohei Kinoshita, all of Tokyo, Japan

[73] Assignee: Kabushiki Kaisha Toshiba, Kanagawa-ken, Japan

[21] Appl. No.: 08/733,716

[22] Filed: Oct. 16, 1996

[30] Foreign Application Priority Data

Oct. 16, 1995 [JP] Japan ..... 7-266910

[51] Int. Cl.[7] ..... G09G 3/36

[52] U.S. Cl. ..... 345/99; 345/213

[58] Field of Search ..... 345/74, 75, 99, 345/213, 100, 98, 55, 520, 3; 348/500, 510, 501, 565, 537, 498, 506; 327/270; 315/169.3, 169.4

[56] References Cited

U.S. PATENT DOCUMENTS

| | | | |
|---|---|---|---|
| 4,275,421 | 6/1981 | Louie et al. | 345/99 |
| 4,337,433 | 6/1982 | Yoshimura | 327/270 |
| 4,580,165 | 4/1986 | Patton et al. | 345/213 |
| 4,688,081 | 8/1987 | Furuhata et al. | 348/506 |
| 4,782,391 | 11/1988 | McNeely et al. | 348/537 |
| 5,157,773 | 10/1992 | Matsumoto et al. | 345/520 |
| 5,635,988 | 6/1997 | Hush | 348/500 |
| 5,638,085 | 6/1997 | Hush | 345/75 |
| 5,726,677 | 3/1998 | Imamura | 345/99 |
| 5,742,261 | 4/1998 | Yuki et al. | 345/132 |

FOREIGN PATENT DOCUMENTS

| | | |
|---|---|---|
| 0577841 | 1/1994 | European Pat. Off. . |
| 4438426 | 5/1995 | Germany . |

*Primary Examiner*—Jeffery Brier
*Attorney, Agent, or Firm*—Pillsbury Madison & Sutro LLP

[57] ABSTRACT

A display device disclosed includes a liquid crystal display panel, a signal-line driver circuit responsive to image data Data and a first clock signal CK1 for generating signals supplied to signal lines, a control signal generator circuit (12) responsive to a reference clock signal for generating and issuing first clock signal CK1 and adjustment clock signals SCK, and a delay-time adjuster circuit (14) which delays the image data by a specified time interval based on a corresponding adjustment clock signal SCK from the control signal generator circuit (12) to adjust the delay time of the first clock signal CK1 as generated by the control signal generator circuit (12) with respect to the image data Data, wherein this delay-time adjuster circuit (14) is provided with phase-locked loop or PLL circuits (16) for correction of the adjustment clock signals SCK, and a PLL circuit (34) for correction of the first clock signal CK1 being supplied to the signal-line driver circuit, thereby causing the first clock signal CK1 and the image data Data to be kept exactly in phase with each other.

22 Claims, 14 Drawing Sheets

48

DISPLAY DEVICE INCLUDING A PHASE ADJUSTER

TECHNICAL FIELD

The present invention relates generally to display devices with an optical modulation layer such as a liquid crystal layer, and more particularly to liquid crystal display (LCD) devices.

BACKGROUND ART

Arrangement of Driver Circuit of Active-Matrix LCD Device

FIG. 13 is a diagram showing a configuration of a driver circuit of an active-matrix LCD device.

Numeral 102 designates an LCD panel which is constituted from a first electrode substrate having a plurality of pixel electrodes arranged in a matrix form, for example, a second electrode substrate with an opposed electrode opposing the pixel electrodes, and a liquid crystal provided as an optical modulation layer disposed between these first and second electrode substrates through orientation films.

Numeral 104 designates a predetermined number of signal-line driver circuits each of which output an image signal, to the signal lines connected to the pixel electrodes, via switching elements such as a thin-film transistor (referred to as "TFT" hereinafter), of the LCD panel 102.

Numeral 108 indicates a scanning-line driver circuit which serves to output a scanning signal to the scanning lines for control of switching elements being electrically connected to the pixel electrodes of LCD panel 102.

Numeral 110 is a control circuit which generates and supplies several signals, including image data Data, a horizontal clock signal CK1 and a start signal ST, to the signal-line driver circuits 104, and which generates and supplies several signals including a vertical clock signal CK2 to the scanning-line driver circuit 108.

Arrangement of Control Circuit

This control circuit 110 will now be described in detail with reference to FIG. 14.

The control circuit 110 comprises a horizontal clock signal generator circuit section 109, a signal generator circuit section 112, and a delay time adjuster circuit section 113.

The horizontal clock signal generator circuit section 109 generates the horizontal clock signal CK1 and an adjustment clock signal SCK based on a reference clock signal CK as provided from an external unit operatively associated therewith, such as a personal computer or the like.

The delay time adjuster circuit section adjusts the phases of image data Data and the horizontal clock signal CK1 to each other to delay the time of generating the horizontal clock signal CK1 by the horizontal clock signal generator circuit section 109, when image data of red (R), green (G) and blue (B) components (referred to as "RGB" hereinafter) are inputted from outside. A circuit configuration thereof is such that latch circuits 114 are connected in series to signal lines of transmission of respective RGB image data Data while constructing multiple stages therein, enabling the image data Data to be delayed due to operation of latches 114. This delayed time can be adjusted in response to receipt of the adjustment clock signal SCK which is fed from the horizontal clock signal generator circuit section 109 to each stage of latch 114.

The signal generator circuit section 112 is responsive to receipt of a synchronization signal EN and reference clock signal CK provided by the external unit such as the personal computer, for generating and issuing the vertical clock signal CK2, horizontal start signal ST and others.

The signal generator circuit section 112 also delays the timing of the generated signals, including the vertical clock signal CK2 and horizontal start signal ST, based on the adjustment clock signal SCK which is defined by the time lag for generating the horizontal clock signal CK1 by the horizontal clock signal generator circuit section 109, and adjusts the phases of generated signals and the horizontal clock signals CK1 to each other, in a manner similar to that of the delay time adjuster circuit.

Operation of Driver Circuit

The operation of the driver circuit 100 thus arranged is as follows.

The RGB image data Data, synchronization signal EN and reference clock signal CK are input to the control circuit 110. In responding, the horizontal clock signal generator circuit section 109 and signal generator circuit section 112 generate and issue the horizontal clock signal CK1, vertical clock signal CK2 and horizontal start signal ST or the like while outputting the adjustment clock signal SCK to respective latches 114 of the delay time adjuster circuit section 113, thus effecting phase adjustment between RGB image data Data and horizontal clock signal CK1.

In the signal-line driver circuit 104 an image signal is generated based on the horizontal clock signal CK1, horizontal start signal ST, image data Data and load signal LD to be output to each of the signal lines of the LCD panel 102.

In the scanning-line driver circuit 108 a scanning signal is generated based on the vertical clock signal CK2 for supplement to the scanning lines of the LCD panel 102.

FIG. 15 shows a timing chart of the horizontal clock signal CK1, horizontal start signal ST, load signal LD and vertical clock signal CK2.

OBJECT OF THE INVENTION

The prior known driver circuit 100 mentioned suffers from several problems as will be set forth below.

(1) While the reference clock signal CK externally supplied thereto is passing through circuit elements such as a phase inversion circuit as provided in the horizontal clock signal generator circuit section 109, it will possibly happen that the duty ratio of reference clock signal CK is deviated. If this is the case, the duty ratio of the horizontal clock signal CK1 fed to the signal-line driver circuit 104 can also be deviated accordingly. Especially, in cases where a phase inversion circuit 150 is disposed at a subsequent node of the output of the final-stage adjustment clock signal SCKn as in the control circuit 110 of FIG. 14, resultant sampling of RGB image signal Data should be carried out utilizing the timing of the falling pulse edge of horizontal clock signal CK1 as demonstrated in the timing chart of FIG. 15. When this is done, if the duty ratio is deviated, the sampling will also deviate in timing causing the set-up time to become insufficient, which in turn leads to the risk of sampling of different image signals Data.

(2) While in the control circuit 110 the horizontal clock signal generator circuit section 109 supplies the adjustment clock signal SCK to the latches 114 of the delay time adjuster circuit section 113 and the signal generator circuit section 112, since these latches 114 are a parallel combination of plural sets of RGB latches, the adjustment clock signal SCK will be supplied to these latches 114 in a parallel signal transmission manner. This can adversely serve to cause such parallel-feed adjustment clock signals SCK to deviate in phase due to undesired distortion in the waveform thereof as raised by the presence of inherent capacitance in the latches 114, leading to a problem in that phase deviation arises letting the RGB image data Data, horizontal clock signal CK1 and horizontal start signal ST be out of phase with the load signal LD or the like.

(3) A further problem is that where the horizontal clock signal CK1 alike and the RGB image data Data are input to the signal-line driver circuit 104, the waveforms thereof can deviate under adverse interference with their associated wiring-line paths and internal circuits of the signal-line driver circuit 104 causing the phase to deviate between them.

After all, due to the aforesaid problems (1) to (3), several kinds of signals will possibly deviate in phase in the timing chart of FIG. 15. In particular, the horizontal clock signal CK1 and image data Data become different in phase from the vertical clock signal CK2 and horizontal start signal ST; if this once happens, since their periods are relatively narrow, the phase focussing can easily be out of work resulting in deviations in phase among them. This will become more serious as the operation speed is much increased to attain extra-high precision image display schemes as demanded endlessly in the art to which the invention pertains.

It is therefore an object of the present invention to provide an improved display device capable of attaining accurate sampling of image data even where the operation speed is increased to achieve such extra-high precision image display schemes thereby enabling accomplishment of excellent, high-quality display images thereon.

BRIEF SUMMARY OF THE INVENTION

In accordance with a first principle of the present invention, a display device includes a display panel having a plurality of display pixels electrically connected to a plurality of signal lines, a control circuit which includes clock signal generator means responsive to receipt of an input reference clock signal for generating based thereon a first clock signal and a phase-adjustment clock signal and phase adjuster means for adjusting based on the adjustment clock signal the relation in phase between input image data and the first clock signal, and a signal-line driver circuit for providing an image signal to the signal lines based on at least the image data and the first clock signal, featured in that the clock signal generator means includes therein a duty-ratio adjuster circuit for correcting the duty ratio of the first clock signal being output to the signal-line driver circuit so that the ratio is approximately 50 percent (%).

With such an arrangement, since the duty ratio of the first clock signal being output to the signal-line driver circuit is corrected to be approximately 50%, even where the operation speed is increased to attain high precision, accurate image-data sampling can be accomplished enabling achievement of excellent display images with enhanced quality.

In accordance with a second principle of the invention, a display device includes a display panel having a plurality of display pixels electrically connected to a plurality of signal lines, a control circuit including clock signal generator means responsive to an incoming reference clock signal for generating a first clock signal and an adjustment clock signal and phase adjuster means for adjusting based on the adjustment clock signal the relation in phase between input image data and the first clock signal, and a signal-line driver circuit for providing an image signal to the signal lines based on at least the image data and the first clock signal, featured in that the clock signal generator means and the phase adjuster means are connected to each other through a PLL circuit for the adjustment clock signal.

With this arrangement also, accurate image-data sampling can be achieved providing high-quality display images.

In accordance with a third principle of the invention, a display device includes a display panel having a plurality of display pixels electrically connected to a plurality of signal lines, a control circuit section for output of image data, a first clock signal and a control signal, and a signal-line driver circuit for supplying an image signal to the signal lines based on the image data and the control signal, featured in that the signal-line driver circuit includes first phase adjuster means on the input side of at least one of the image data, the first clock signal and the control signal.

It thus becomes possible, by providing the signal-line driver circuit with the first phase adjuster means disposed therein also, to achieve accurate image-data sampling attaining excellent display images.

In accordance with a fourth principle of the invention, a display device includes a display panel having a plurality of display pixels electrically connected to a plurality of signal lines, a control circuit including clock signal generator means responsive to an input reference clock signal for generating a first clock signal and an adjustment clock signal and phase adjuster means for adjusting based on the adjustment clock signal the relation in phase between the first clock signal and one of input image data and a control signal, and a signal-line driver circuit for providing an image signal to the signal lines based on the image data, the first clock signal and the control signal, featured in that the clock signal generator means includes therein a built-in duty-ratio adjuster circuit for correction of the duty ratio of the first clock signal being output to the signal-line driver circuit so that the ratio is approximately 50%.

DETAILED DESCRIPTION OF THE INVENTION

First Embodiment

Figure 13:
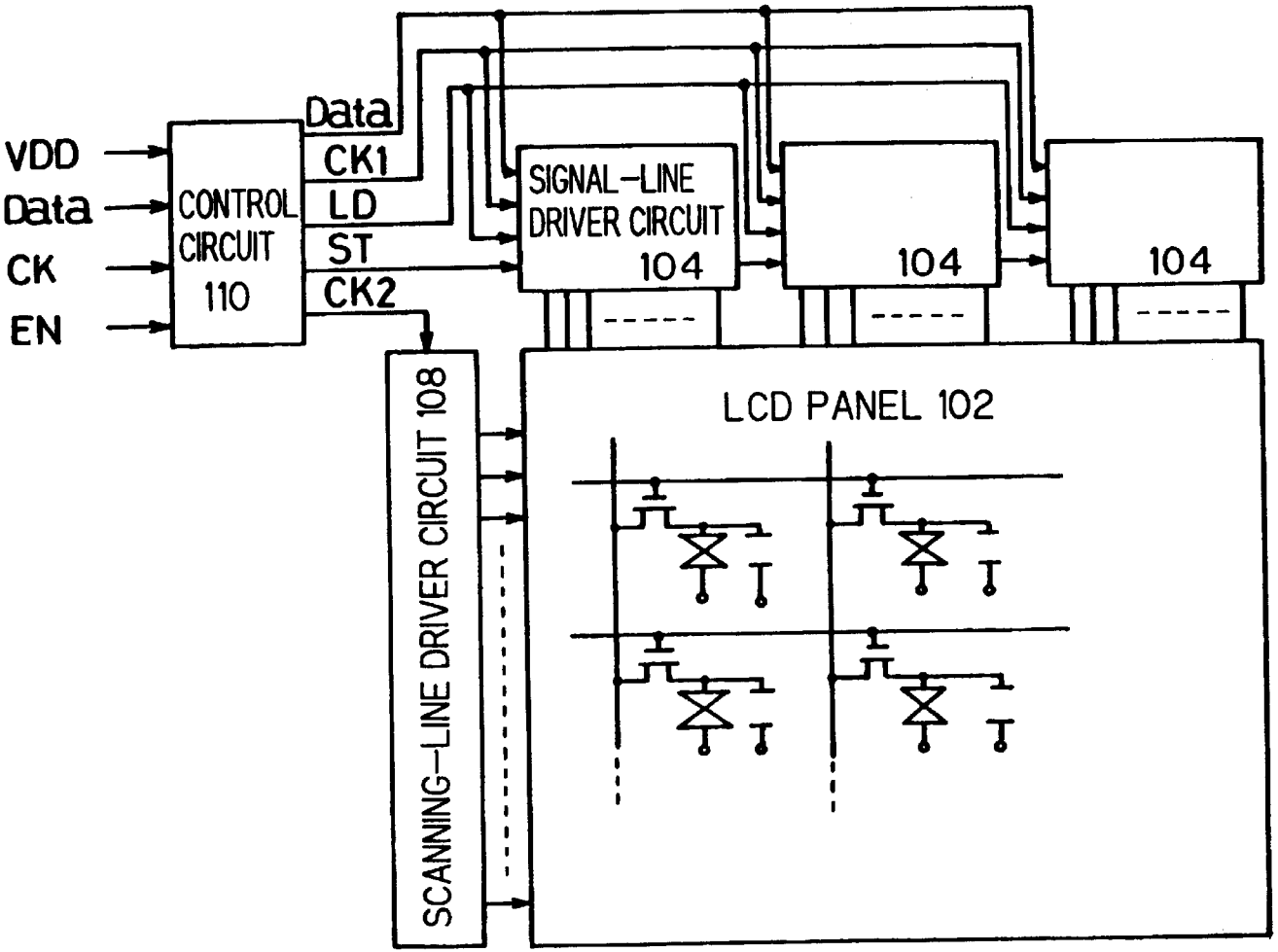
FIG.13 (PRIOR ART)
FIG. 13 is a circuit diagram of a driver circuit of one prior known liquid crystal display device.
Figure 14:
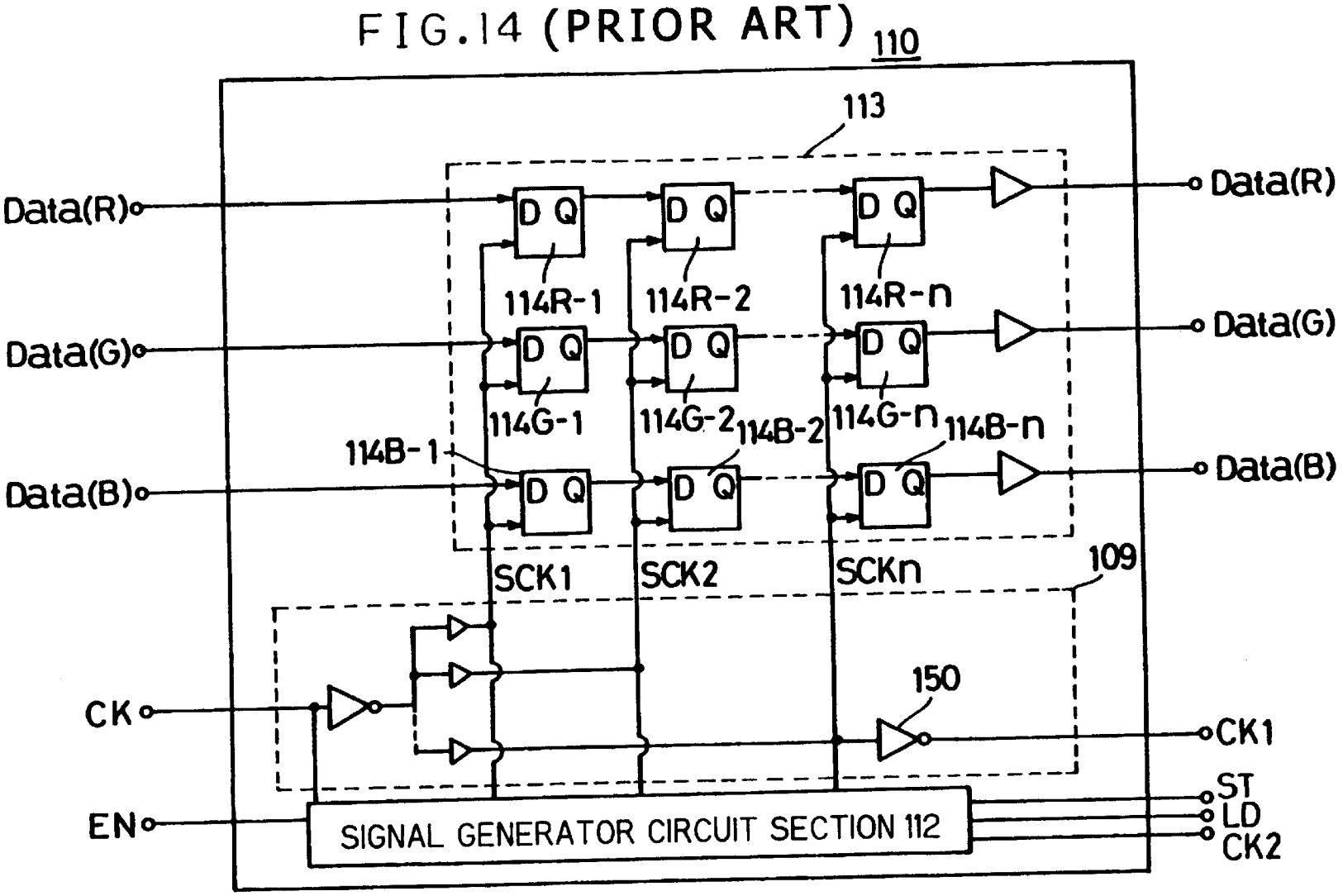
FIG. 14 (PRIOR ART)
FIG. 14 is a circuit diagram of a control circuit as provided in the prior art device.
Figure 15:
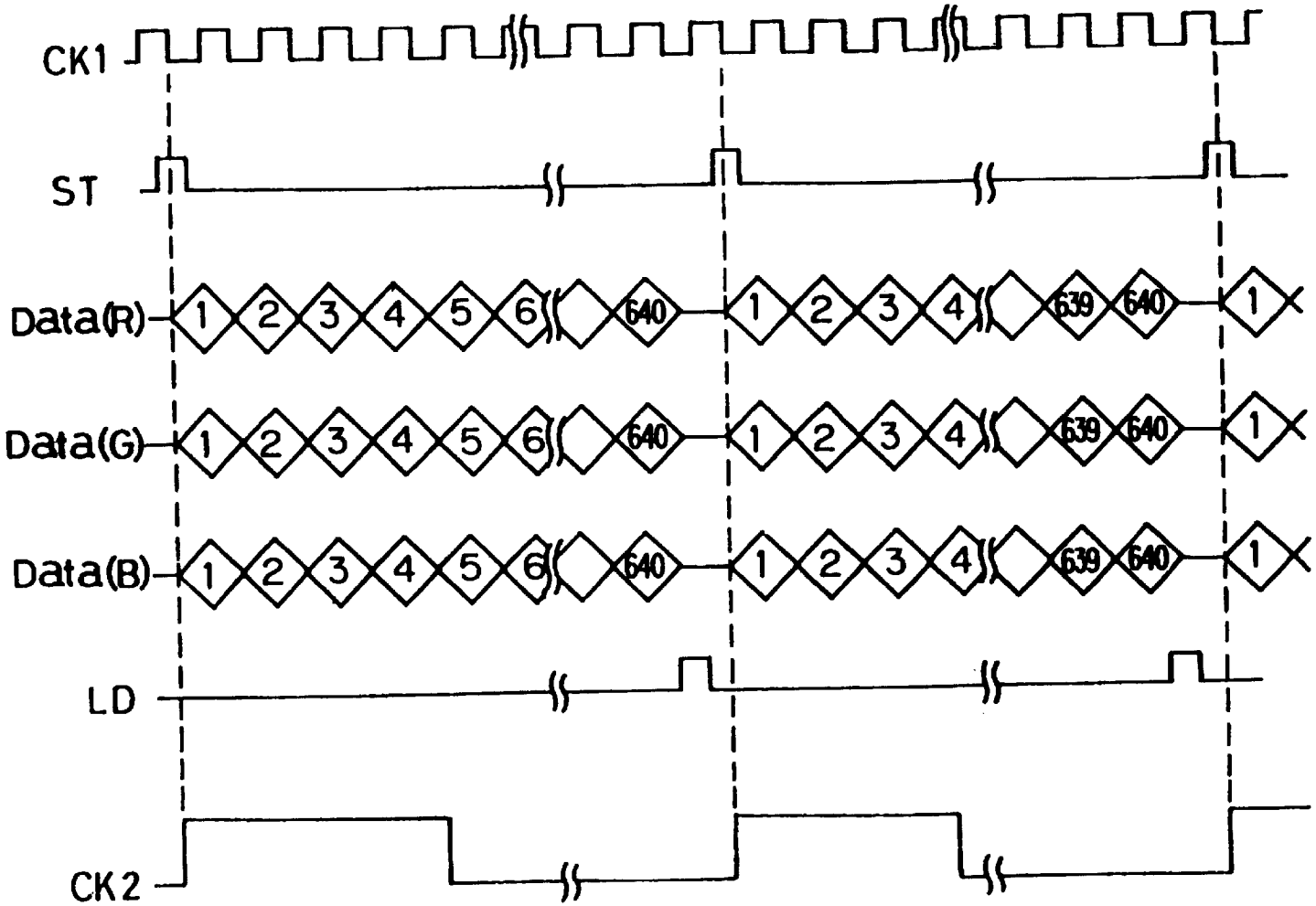
FIG.15 (PRIOR ART)
FIG. 15 is a timing chart of respective signals in the prior art.

A driver circuit adaptable for use in an active-matrix liquid crystal display (LCD) device in accordance with a first embodiment of the present invention will now be described with reference to FIGS. 1 through 10. Note here that the overall configuration of the active-matrix LCD device may be similar to that shown in FIG. 13.

(Arrangement of Control Circuit)

Figure 1:
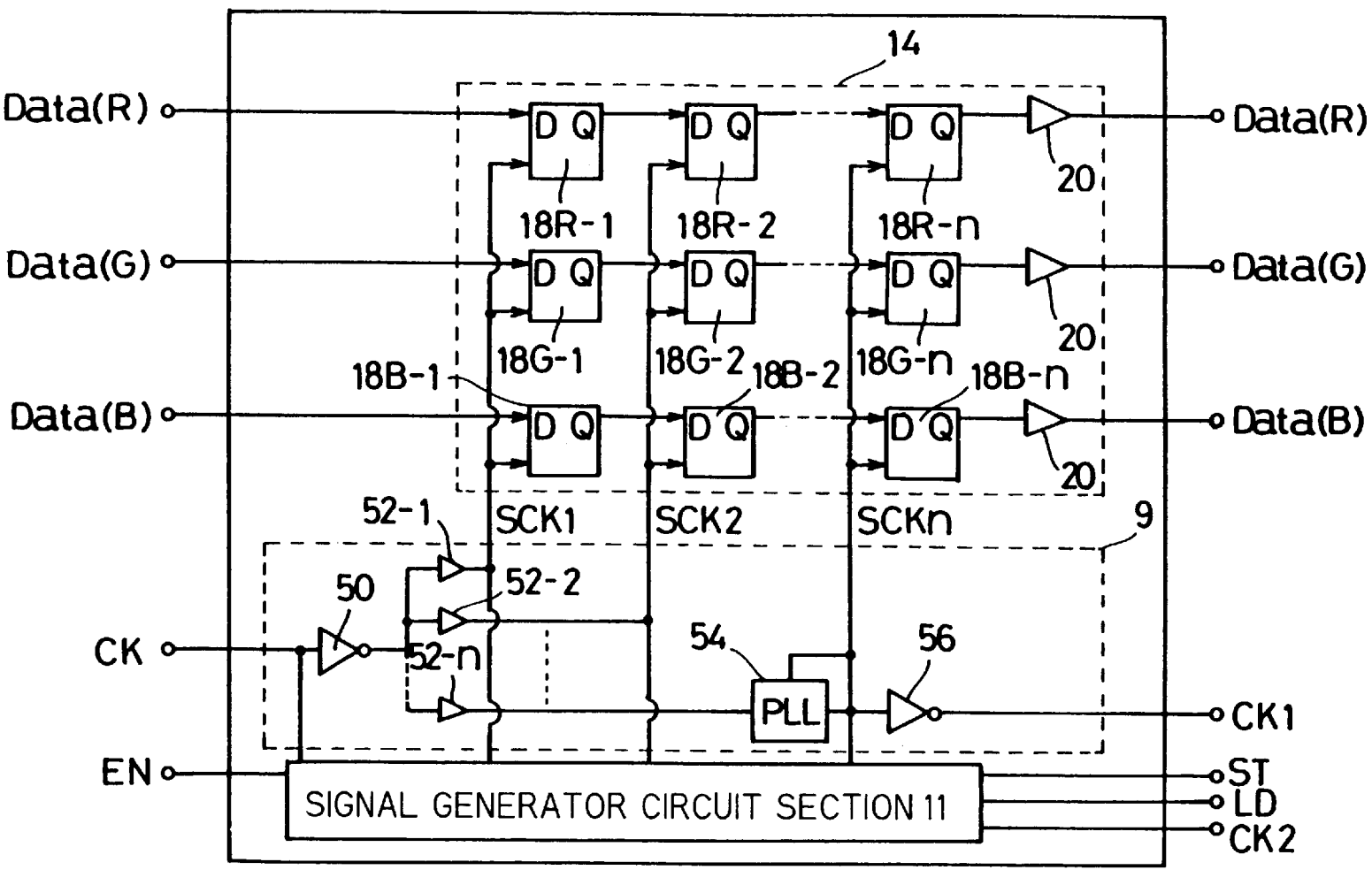
FIG. 1 is a circuit diagram of a control circuit of a liquid crystal driver device in accordance with a first embodiment of the present invention.

Referring now to FIG. 1, there is shown a circuit configuration of a control circuit 10 as employed in the driver circuit of this embodiment, wherein the control circuit 10 is integrally arranged in a semiconductor chip as an integrated circuit (IC) element.

The control circuit 10 includes a horizontal clock signal generator circuit section 9 for generating and issuing a horizontal clock signal CK1 and phase-adjustment clock signals SCK, a signal generator circuit section 11 for producing several signals including a horizontal start signal ST, a vertical clock signal CK and a load signal LD, and for delaying them by a specified time interval, and a delay-time adjuster circuit section 14 for receiving RGB color image data items Data, which may be input as 8-bit digital signals, for example, and for delaying a respective one of these signals by a predefined time interval.

Figure 7:
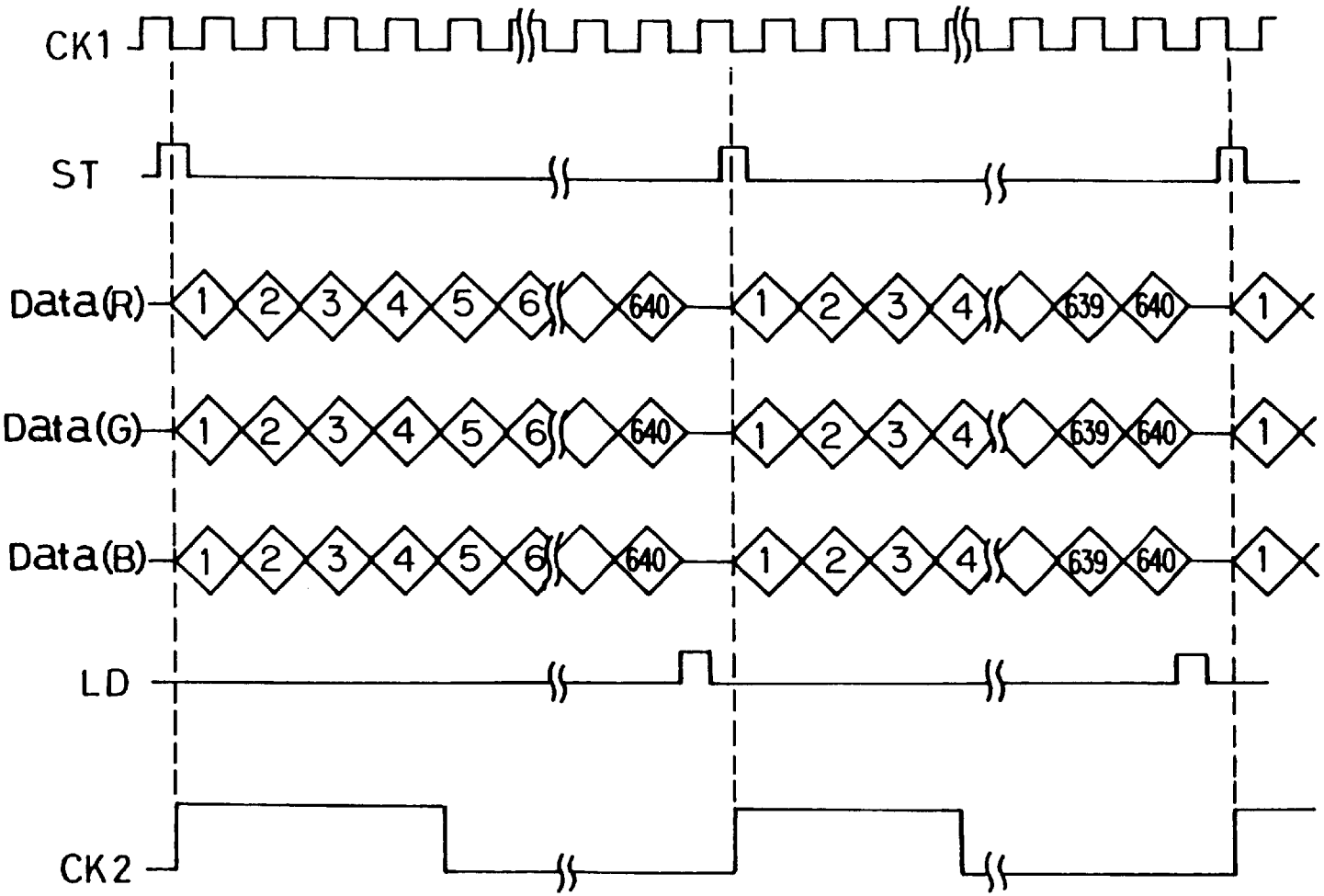
FIG. 7 is a timing chart of respective signals in the first embodiment.
Figure 8:
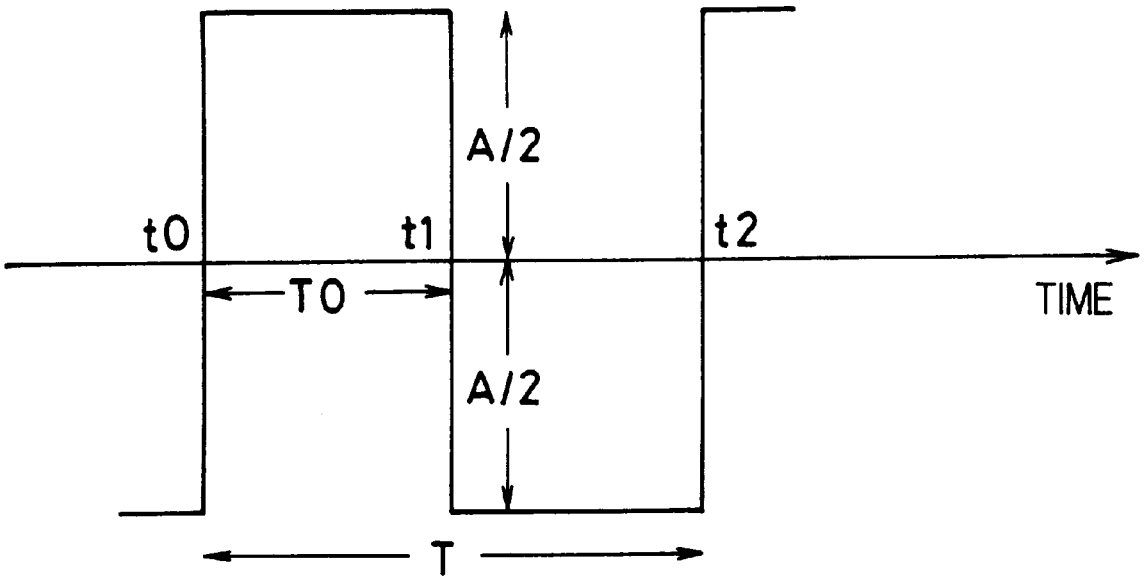
FIG. 8 is a diagram for explanation of the duty ratio in accordance with the principles of the present invention.

See FIG. 7, which shows a timing chart of the horizontal clock signal CK1, horizontal start signal ST, image data Data, load signal LD and vertical clock signal CK2.

The horizontal clock signal generator circuit section 9 is constituted from a phase inversion circuit 50 consisting of an inverter circuit that inverts by 180 degrees the phase of a reference clock signal CK as input thereto. The horizontal clock signal generator circuit section 9 also includes a predetermined number (n) of buffers 52-1, 52-2, . . . , 52-n that are parallel-connected to an output terminal of the phase inversion circuit 50 for generating and issuing adjustment clock signals SCK, each of which is supplied to a corresponding one of RGB latches 18R-1, 18G-1, 18B-1; 18R-2, 18G-2, 18B-2; . . . ; 18R-n, 18G-n, 18B-n constituting the delay-time adjuster circuit section 14 and latches (these may be similar in configuration to those in the delay-time adjuster circuit section 14, and not shown here) of the signal generator circuit section 11. The final-stage latches 18R-n, 18G-n, 18B-n of the delay-time adjuster circuit section 14 and the output of buffer 52-n for control of the final-stage latches (not shown) in the signal generator circuit section 11 are connected to a phase-locked loop (PLL) circuit 54. This PLL circuit 54 has two outputs diverted: one output is connected to the final-stage latches 18R-n, 18G-n, 18B-n in delay-time adjuster circuit section 14 and the final-stage latches in signal generator circuit section 11; the other is tied to a phase inversion circuit 56 consisting of an inverter circuit or the like. This phase inversion circuit 56 generates at its output an inverted signal which is then sent forth from the control circuit 10 as the horizontal clock signal CK1.

The delay-time adjuster circuit section 14 is arranged so that it includes a serial combination of n latches 18 as operatively coupled at its input to a corresponding one of R, G and B data items Data(R), Data(G), Data(B) of the color image data Data, and also coupled at the output of final-stage latch 18R-n, 18G-n or 18B-n to an amplifier 20 as shown. For instance, upon receipt of incoming red (R) data item of the image data Data, a corresponding row of latches 18R-1, 18R-2, . . . , 18R-n are connected in series thereto; for green (G) data, another row of latches 18G-1, 18G-2, . . . , 18G-n are series-connected thereto; and, for blue (B), the remaining row of latches 18B-1, 18B-2, . . . , 18B-n are series-coupled in a similar manner.

In the horizontal clock signal generator circuit section 9 the first buffer 52-1 issues a first adjustment clock signal SCK-1, which is then supplied in parallel to the individual one of the first-stage latches of respective RGB image data Data, that is, the latches 18R-1, 18G-1 and 18B-1. Hence, each latch 18 operates in response to the first adjustment clock signal SCK-1.

Similarly, also in each stage of latch 18 other than the final-stage one, a corresponding adjustment clock signal SCK is input causing each RGB image data Data to be delayed by a predetermined time interval.

Further, the n-th adjustment clock signal SCK-n fed from the PLL circuit 54 as discussed previously is input to the final-stage latches 18R-n, 18G-n, 18B-n forcing each RGB image data Data to be delayed in time so as to be synchronized with the horizontal clock signal CK1.

In a manner similar to that of each RGB image data, several control signals such as the horizontal start signal ST, vertical clock signal CK2 and load signal LD generated by the signal generator circuit section 11 are also delayed by a predetermined time interval based on each adjustment clock signal SCK such that the individual signal is in synchronization with the horizontal clock signal CK1.

The PLL circuit as employed herein is defined as a phase-locked loop circuit which provides an oscillation output that is kept constantly in phase and in frequency with an input signal thereof at any events, and which monitors and compares the oscillation output with the input signal to ensure that the duty ratio thereof is 50% while controlling its oscillator so that a difference between the two signals is substantially zero (0) constantly.

Here, the duty ratio is defined as follows. See FIG. 8, in the waveform of a pulse signal, where time points t0, t1, t2 are defined as "zero-cross" points or ½ of the amplitude A, T0 is defined as T0=t1−t0 whereas the period of the waveform T is T=t2−t0. Under this condition, the duty ratio is given as T0/T.

With the control circuit 10 thus arranged, based on an output of the PLL circuit section 54, the horizontal clock signal CK1 is generated and the signal generator circuit section 11 and the final-stage latches 18R-n, 18G-n, 18B-n constituting the delay-time adjuster circuit section 14 is controlled. For this reason, the horizontal clock signal CK1 fed from the control circuit 10 is kept substantially in phase with respective image signals Data(R), Data(G), Data(B), horizontal start signal ST, vertical clock signal CK2, load signal LD and the like.

Further, the output from the PLL circuit 54 is or approximates 50% in duty ratio; therefore, as shown in the timing chart of FIG. 7, even where the RGB image signals Data are subject to sampling in signal-line driver circuit 24 by utilizing the timing of descending pulse edges of the horizontal clock signal CK1, it will no longer happen that the timing of sampling deviates significantly enabling achievement of reliable sampling of image signals Data even at extra-high operating speed.

Another advantage of the illustrative circuit configuration is that even when the duty ratio of the incoming reference clock signal CK is much deviated from 50%, the duty ratio can be compensated for.

(Arrangement of Signal-Line Driver Circuit)

Figure 4:
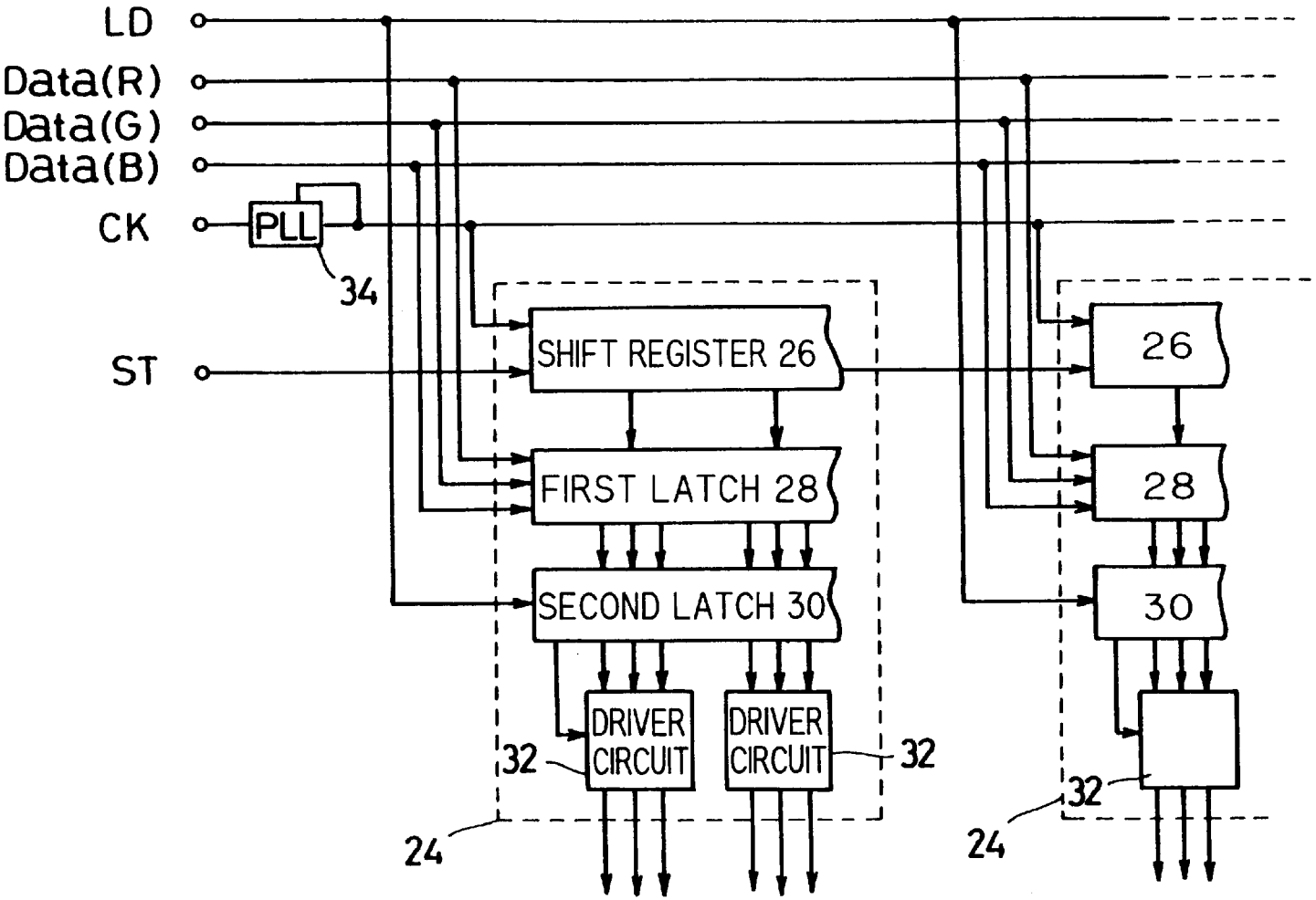
FIG. 4 is a circuit diagram of a signal-line driver circuit of the liquid crystal driver device in accordance with the first embodiment of the invention.

FIG. 4 is a diagram showing a configuration of signal-line driver circuits 24 as employed in the LCD driver circuit embodying the present invention, wherein a plurality of signal-line driver circuits 24 are disposed and electrically connected. As shown in FIG. 4, for example, each signal-line driver circuit 24 typically includes a shift register section 26, a first latch section 28, a second latch section 30, and a plurality of driver circuit sections 32, all of which are integrated in the semiconductor chip. The shift register section 26 is connected to receive the horizontal start signal ST and horizontal clock signal CK1 as fed from the control circuit; 10, whereas the first latch section 28 is to receive the RGB image data Data. The second latch section 30 receives the load signal LD from control circuit 10. Using these signals, image signals are produced which are supplied from the driver circuits 32 to the signal lines.

While the horizontal start signal ST and RGB image data Data are directly input to the shift register section 26 and first latch section 28, the horizontal clock signal CK1 is input to the shift register section 26 via a PLL circuit 34 (as inserted into the clock-signal line). By passing through this PLL circuit 34, any possible distortion of waveform of the horizontal clock signal CK1 and deviation or "breakage" of the duty ratio thereof can be corrected enabling the horizontal clock signal to be input while being kept exactly in phase with RGB image data Data.

With such an arrangement, even where the display operation increases in speed while having the horizontal clock signal CK1 and RGB image data Data increased in frequency with the period decreased, it becomes possible to suppress or eliminate degradation of the horizontal clock signal CK1 and deviation of the duty ratio thereof otherwise occurring due to adverse influence with the time constant as defined by inherent parasitic or stary capacitances on wiring lines, to ensure that the two can be exactly in phase with each other constantly. This advantageously serves to achieve accurate, high-speed synchronization in liquid crystal driving schemes, which in turn leads to the possibility of providing extra large-size LCD devices.

Figure 5:
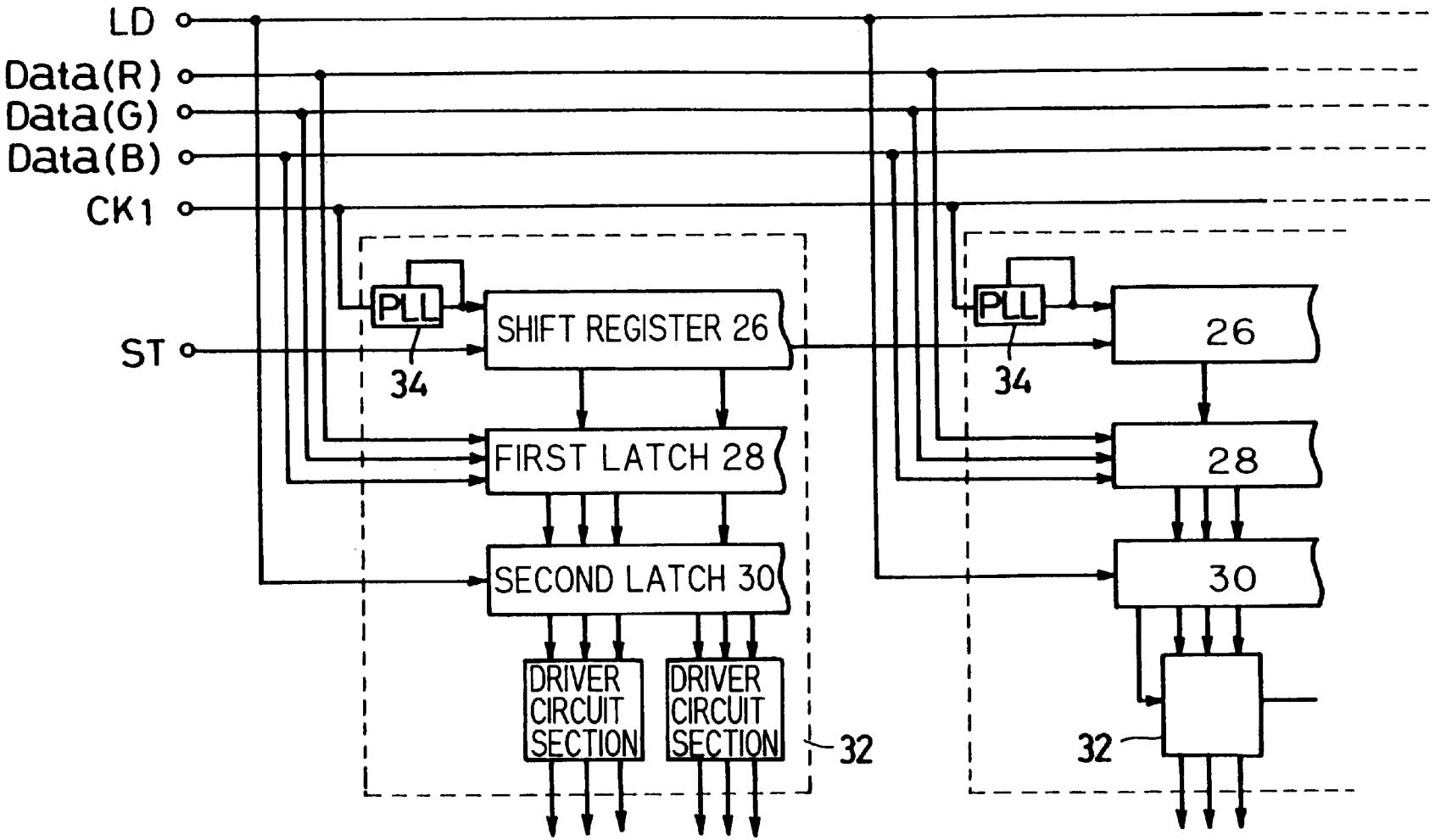
FIG. 5 is a circuit diagram showing a modification of the signal-line driver circuit in FIG. 4.

Although in the illustrative embodiment respective signal-line driver circuits 24 are integrated in the semiconductor chip as an IC element while allowing the PLL circuit 34 to be operatively coupled in common to respective signal-line driver circuits 24 as a separate circuit component therefor, the present invention should not be limited exclusively to such configuration. By way of example, as shown in FIG. 5, the signal-line driver circuits 24 may be modified so that each comes with its exclusive PLL circuit 34 as integrally formed in the same semiconductor chip.

Figure 6:
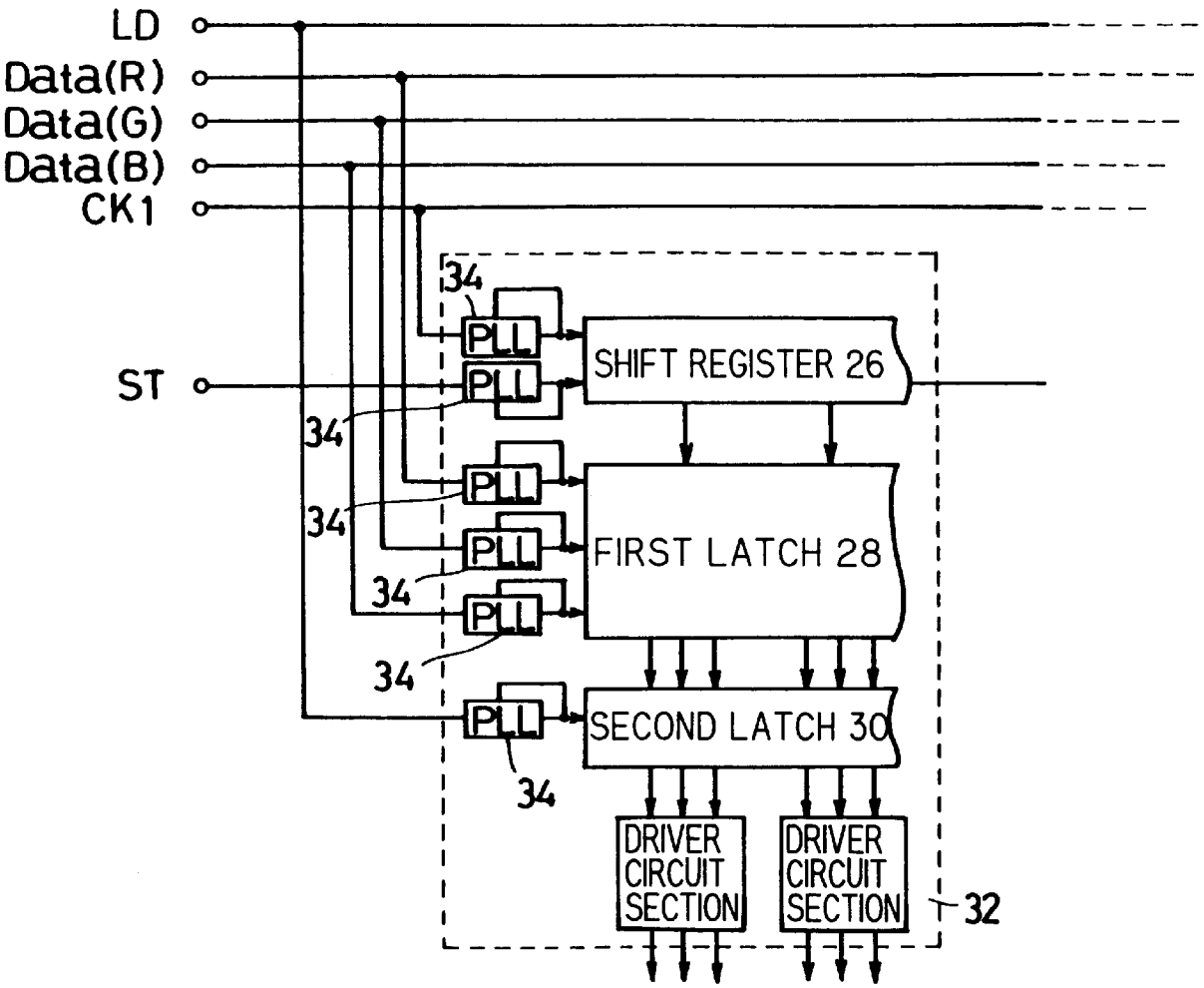
FIG. 6 is a circuit diagram showing another modification of the signal-line driver circuit in FIG. 4.

Alternatively, as shown in FIG. 6, the PLL circuit 34 may be added also to other signal transmission paths for the RGB image data Data, start signal ST and load signal LD, not only to the horizontal clock signal CK1.

(Arrangement of PLL Circuit)

PLL circuits generally include analog PLL circuits and digital ones. Any one of such types may be employed as the PLL circuit(s) 34 in the illustrative embodiment. Digital PLL circuits can offer an largely increased time constant by supplying control while digitalizing phase comparison results between the input frequency and output frequency, averaging resultant phase difference data during time elapse of several seconds, and detecting extra low-frequency phase deviations alone, thereby lowering the jitter cutoff frequency. Further the duty ratio can easily be controlled at 50%.

Figure 9:
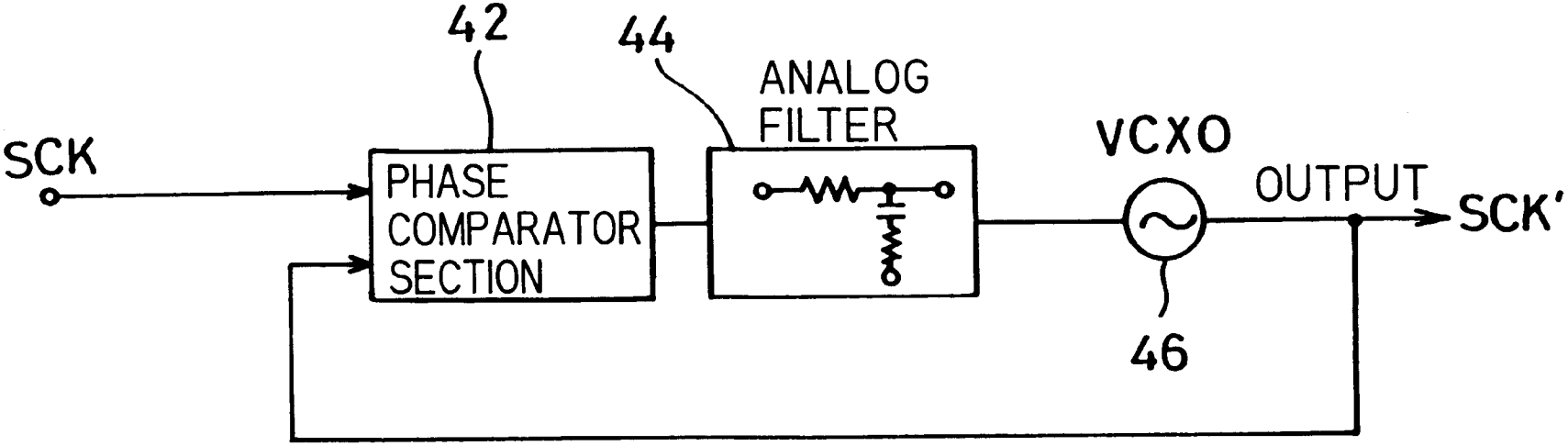
FIG. 9 is a circuit diagram of an analog PLL circuit.

FIG. 9 shows one exemplary configuration of an analog PLL circuit 40, which includes a series combination of a phase comparator section 42, an analog filter 44, and a voltage-controlled oscillator (VCO) 46 as labelled by "VCXO" here, with an output thereof being fed back to the phase comparator section 42. In this case, as the accuracy of VCXO 46 increases, controlling of the duty ratio at 50% may become easier accordingly.

Figure 10:
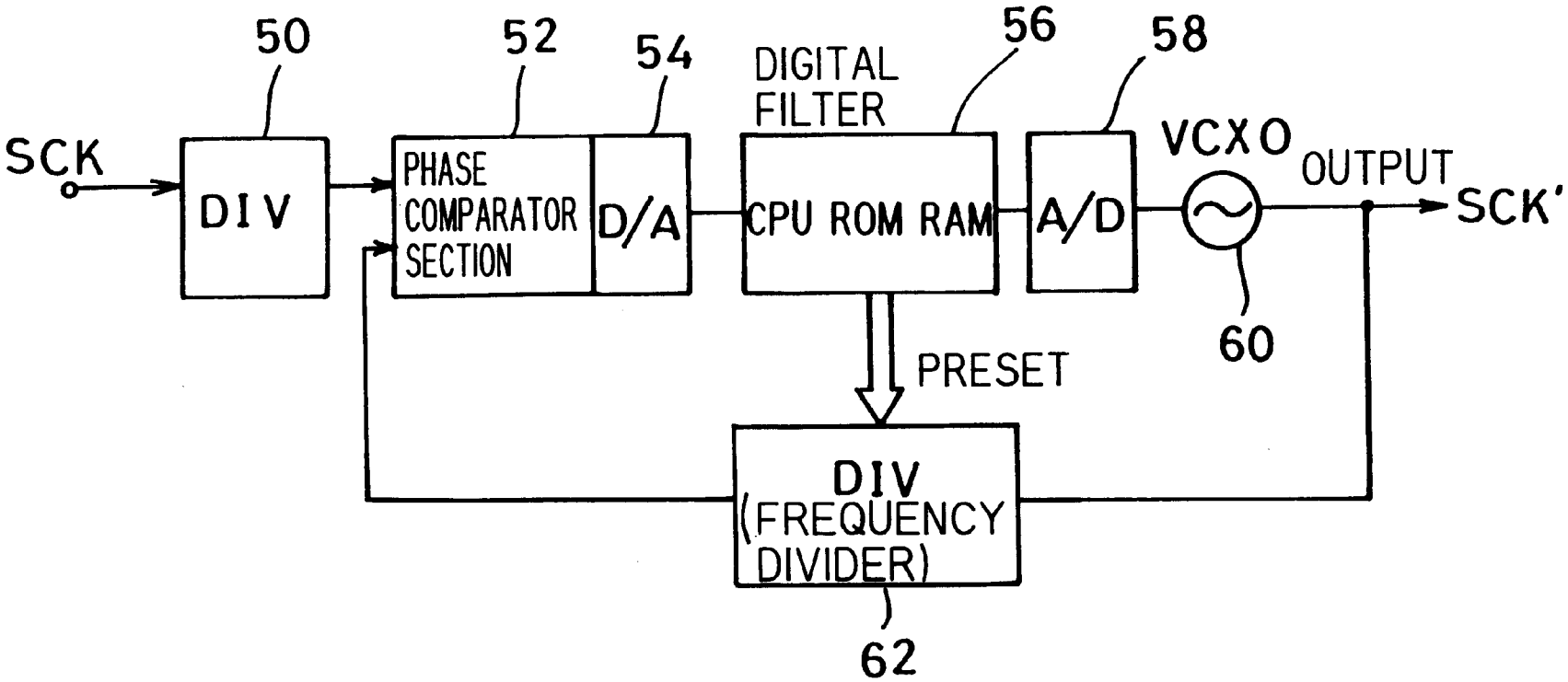
FIG. 10 is a circuit diagram of a digital PLL circuit.

FIG. 10 shows one exemplary configuration of a digital PLL circuit 48. This digital PLL circuit 48 includes a series connection of a frequency divider 50 as labelled "DIV" here, a phase comparator section 52, a digital-to-analog (D/A) converter 54, a digital filter 56, an analog-to-digital (A/D) converter 58, and a VCO 60 as labelled "VCXO" with its output being fed back to the phase comparator 52 through DIV 62. The digital filter 56 operates to preset DIV 62.

(Modifications)

Figure 2:
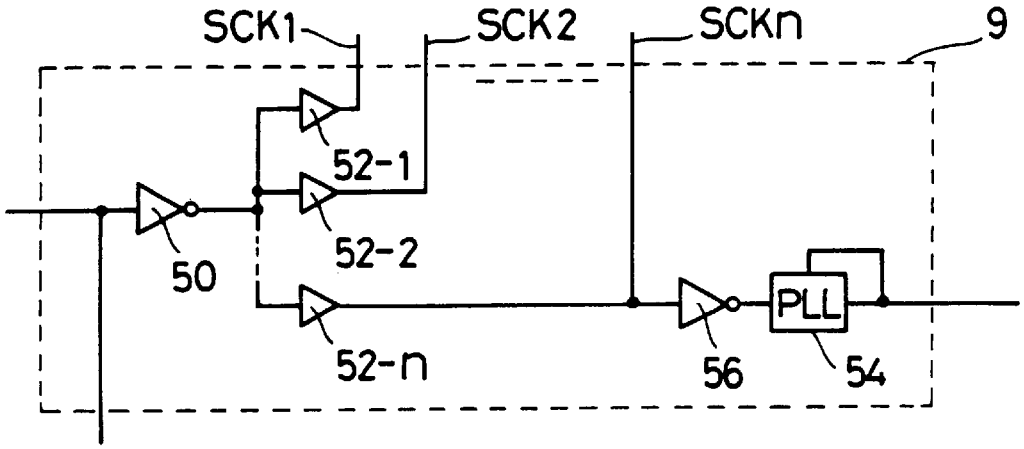
FIG. 2 is a circuit diagram showing one modification of the control circuit section shown in FIG. 1.

In the control circuit 10 of FIG. 1 the PLL circuit 54 is connected to the final-stage buffer 52-n; alternatively, the same may be provided on the output side of the phase inversion circuit 56 as shown in FIG. 2.

Figure 3:
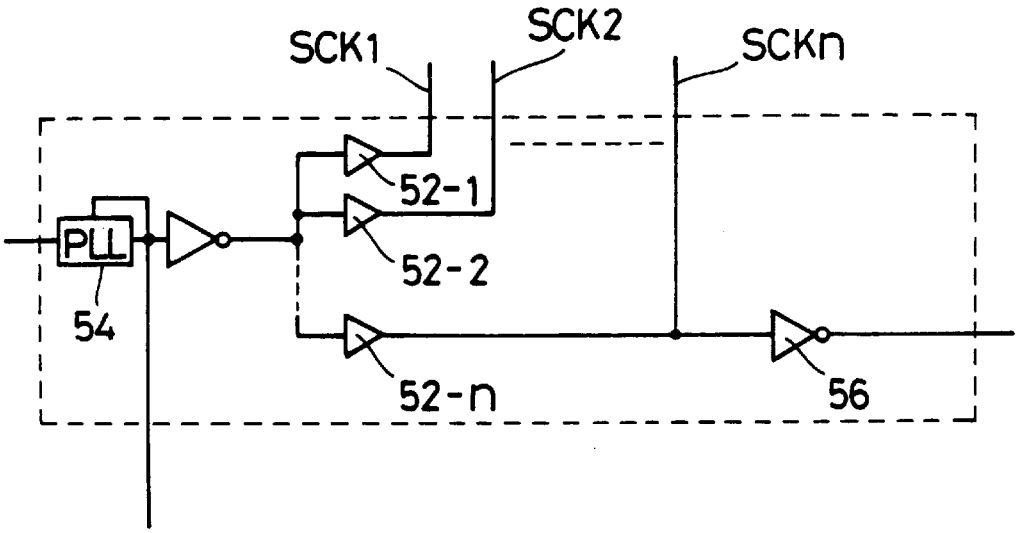
FIG. 3 is a circuit diagram showing another modification of the control circuit section of FIG. 1.

Another possible modification is that as shown in FIG. 3, the PLL circuit 54 is connected to the input of phase inversion circuit 50. In this case, the control operation of control circuit 10 may be facilitated because of the fact that wave-shaping is executed even where the duty ratio of an externally supplied reference clock signal CK is deviated from its intended value. Especially, with such an arrangement, the signal generator circuit section 11 does generate and issue several control signals including the start signal ST and load signal LD based on the reference clock signal CK with its duty ratio being compensated for by the PLL circuit 54. This essentially enables several kinds of signals to be exactly in phase with each other accomplishing excellent, high-quality/high-precision display images even in extra-high speed operation.

In the foregoing embodiment the PLL circuit or circuits are employed for holding the duty ratio at 50%; however, zero-cross detectors or the like may alternatively be used therefor.

Second Embodiment

A control circuit 10 in accordance with a second embodiment of the present invention will now be described with reference to FIG. 11. In this embodiment also, the control circuit 10 is integrated as an IC element on a semiconductor chip substrate together with other elements as mounted thereon.

Figure 11:
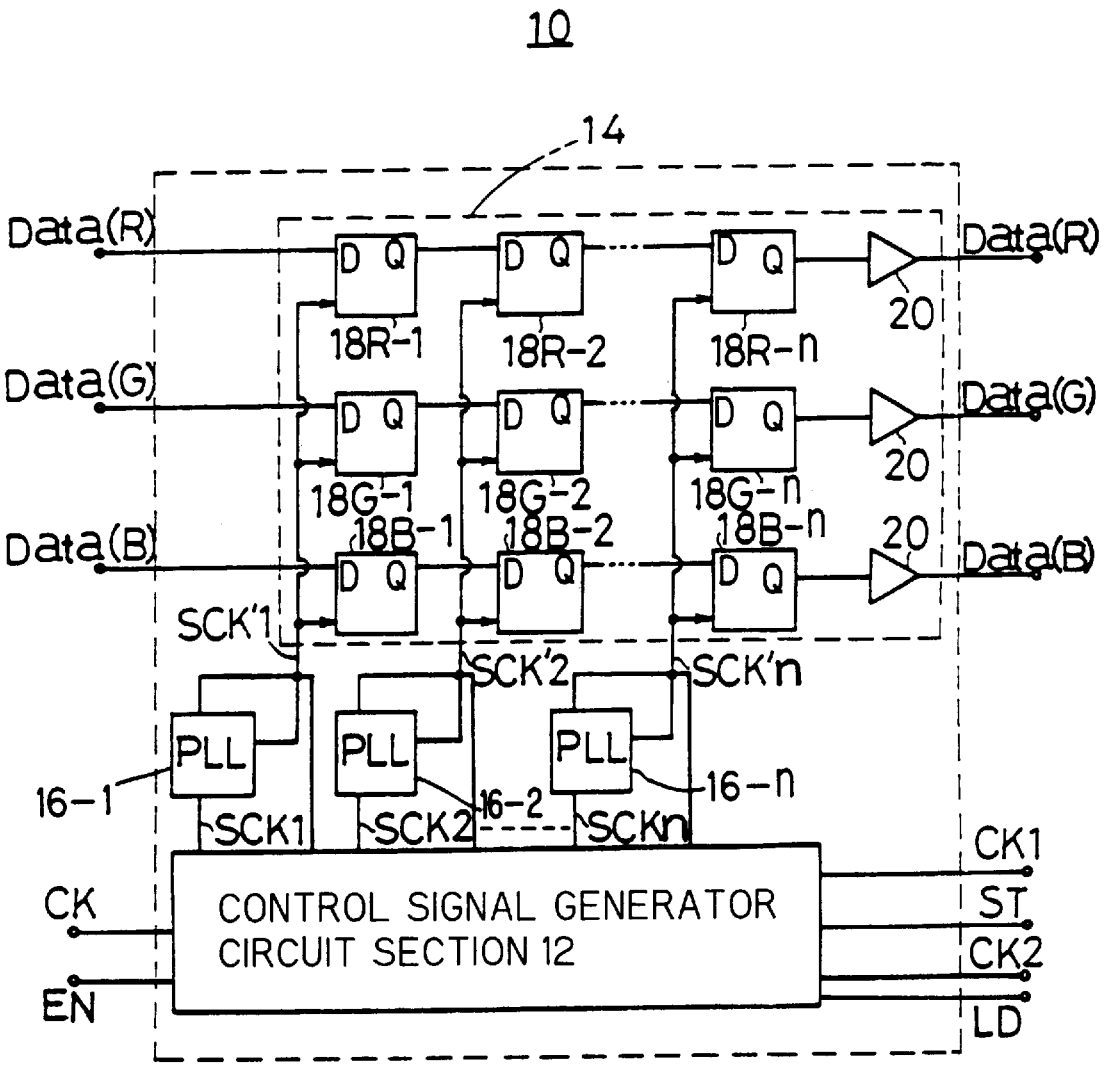
FIG. 11 is a circuit diagram of a control circuit of a liquid crystal driver device in accordance with a second embodiment of the invention.
Figure 12:
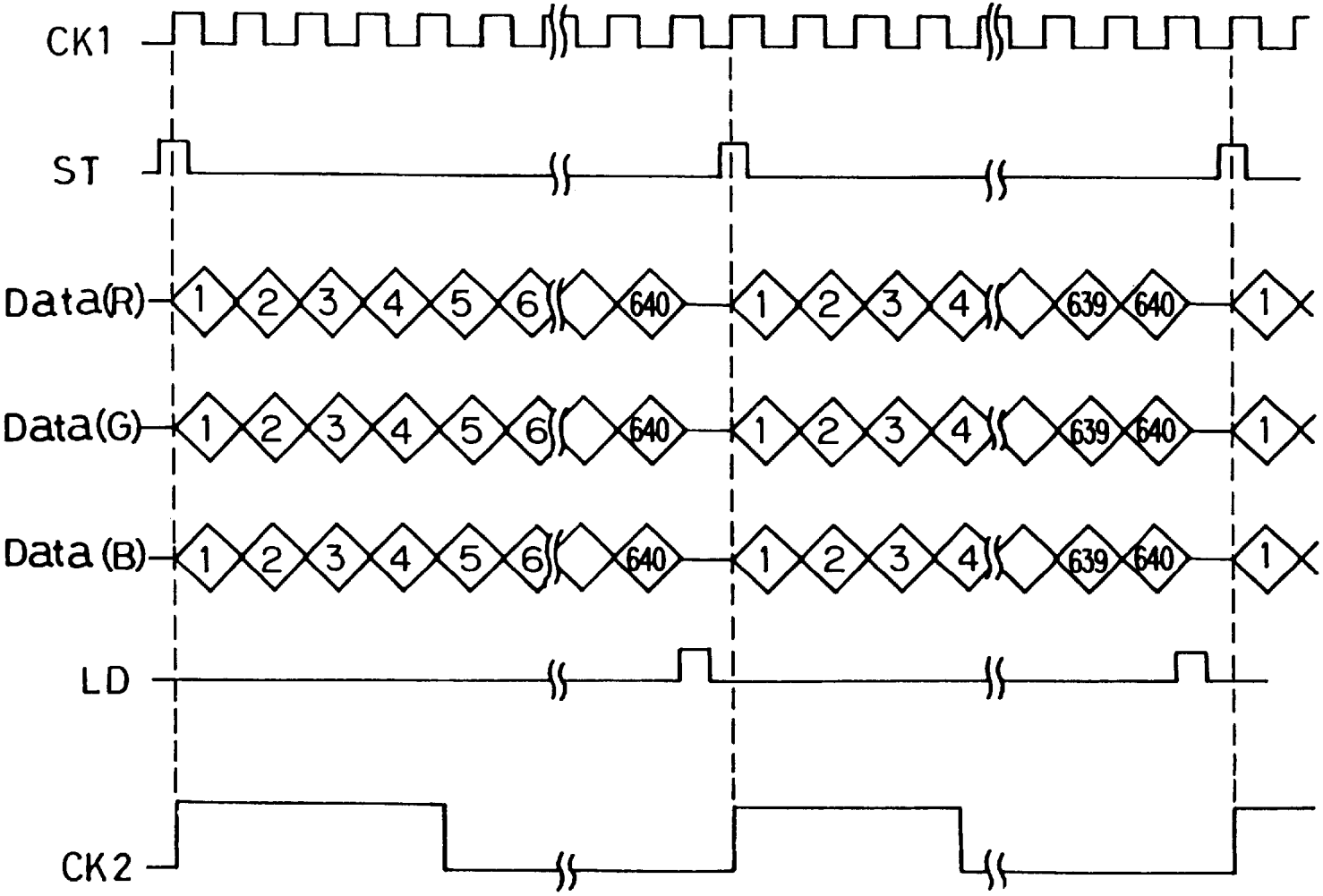
FIG. 12 is a timing chart of respective signals in the second embodiment.

As shown in FIG. 11, the control circuit 10 includes a signal generator circuit section 12 which is responsive to receipt of a reference clock signal CK and synchronization signal EN as externally supplied from an outside personal computer or the like associated therewith, for generating and issuing the horizontal clock signal CK1, horizontal start signal ST, vertical clock signal CK2 and phase-adjustment clock signals SCK, and a delay-time adjuster circuit section 14 that operates to delay RGB image data Data by a predefined time interval. In this embodiment, a combination of the horizontal clock signal generator circuit section 9 as used in the first embodiment and the signal generator circuit section 11 for production of several signals including the horizontal start signal ST, vertical clock signal CK2 and load signal LD is called the "signal generator circuit section 12."

While the signal generator circuit section 12 generates and issues the adjustment clock signals SCK1, SCK2, . . . , SCKn that may each act as a reference signal for operation control of the delay-time adjuster circuit section 14, this circuit 12 does not directly provide such output signals SCK to the delay-time adjuster circuit section 14; rather, it provides the same thereto via respective PLL circuits 16-1, 16-2, . . . , 16-n shown.

The delay-time adjuster circuit section 14 includes therein a plurality of latches 18 with each series combination of latches being connected to a corresponding one of RGB image data Data while allowing each color data output to be sent forth via an amplifier 20. In other words, the latches 18 include a first row of latches 18R-1, 18R-2, . . . , 18R-n as series-connected to the red (R) image data Data(R). The latches 18 also include a second row of series-connected latches 18G-1, 18G-2, . . . , 18G-n for the green (G) image data Data(G), and a third row of series latches 18B-1, 18B-2, . . . , 18B-n for the blue (B) image data Data(B).

The signal generator circuit section 12 generates a first adjustment clock signal SCK-1, which is corrected by its associated PLL circuit 16-1 providing a corrected first adjustment clock signal as labelled "SCK'-1." This clock signal is then passed to an associative column or "first-stage" latches 18R-1, 18G-1, 18B-1, and further to the signal generator circuit section 12 in a parallel manner, causing a respective one of these first-stage latches 18R-1, 18G-1, 18B-1 to operate in response to such PLL-corrected first adjustment clock signal SCK'-1. Providing the PLL circuit 16-1 may ensure that even where three latches 18R-1, 18G-1, 18B-1 are parallel-connected, the first adjustment clock signal SCK'-1 will no longer be out of phase without being adversely affected therefrom. Consequently, it makes it possible for RGB image data Data to be kept exactly in phase with the first adjustment clock signal SCK-1.

Similarly, regarding the second-stage latch set 18R-2, 18G-2, 18B-2 also, since a second adjustment clock signal SCK-2 is input thereto via a PLL circuit 16-2, accurate phase adjustment or "synchronization control" can be accomplished letting the RGB image data be exactly in phase with the second adjustment clock signal. The same is true for the remaining, third to final-stage latches, enabling by adequate PLL-phase correction achievement of accurate synchronization between each stage latch set and its associated adjustment clock signal SCK.

It should be noted that the PLL circuits 16 as employed in the control circuit 10 and the signal-line driver circuits 24 connected to the control circuit 10 may be similar in configuration to those as used in the first embodiment as discussed previously.

APPLICABILITY IN INDUSTRIAL USE

In accordance with the present invention, there can be provided a display device capable of achieving accurate sampling of image data even where the operation speed is increased to attain extra-high precision image display schemes thereby enabling accomplishment of excellent, high-quality display images thereon.

What is claimed is:

1. A display device comprising:

a display panel having a plurality of display picture elements electrically connected to a plurality of signal lines;

a control circuit for receiving a reference clock signal and a serial digital image data signal and generating (A) a pixel clock signal based on at least the reference clock signal and having the same frequency as the reference clock signal, (B) a horizontal start signal based on at least one among the reference clock signal and the pixel clock signal, and (C) a synchronized serial digital image data signal based on the input serial digital image data signal and the pixel clock signal, said control circuit comprising 1) a plurality of latch circuits, said plurality of latch circuits being connected in series and transferring the input serial digital image data signal so as to synchronize the input serial digital image data signal to the pixel clock signal, and 2) a duty ratio adjuster circuit for adjusting a duty ratio of the reference clock signal and outputting the pixel clock signal; and a signal line driver circuit for (A) converting the synchronized serial digital image data signal into a parallel digital image data signal corresponding to said signal lines, said parallel digital image data signal being in accordance with the pixel clock signal and the horizontal start signal, and (B) providing an image signal to said signal lines.

2. The display device according to claim 1, wherein the ratio of the frequency of an input of said duty ratio adjuster circuit to the frequency of an output of said duty ratio adjuster circuit is substantially unity.

3. The display device according to claim 1, wherein said duty ratio adjuster circuit comprises a phase-locked loop circuit adjusting the duty ratio of the reference clock signal to substantially 50 percent (%).

4. The display device according to claim 3, wherein the frequency and phase of an output of said duty ratio adjuster circuit are substantially equal to the frequency and phase of an input of said duty ratio adjuster circuit.

5. The display device according to claim 1, wherein the frequency and phase of an output of said duty ratio adjuster circuit are substantially equal to the frequency and phase of an input of said duty ratio adjuster circuit.

6. The display device according to claim 1, said duty ratio adjuster circuit being provided in the last of said plurality of latch circuits.

7. The display device according to claim 1, wherein, at a first point, a clock signal based at least on the reference clock is inputted to at least one of said plurality of latch circuits, wherein a signal based at least on the reference clock is inputted to said duty ratio adjuster circuit at a point subsequent to the first point.

8. The display device according to claim 1, wherein, at a first point, a clock signal based at least on the reference clock is inputted to at least one of said plurality of latch circuits, wherein a signal based at least on the reference clock is inputted to said duty ratio adjuster circuit at a point prior to the first point.

9. The display device according to claim 1, wherein the reference clock signal is a digital signal.

10. The display device according to claim 1, wherein an input to the duty ratio adjusting circuit is a digital signal.

11. A display device comprising:

a display panel having a plurality of display picture elements electrically connected to a plurality of signal lines;

a control circuit for receiving a reference clock signal and a serial digital image data signal and generating (A) a pixel clock signal based on at least the reference clock signal and having the same frequency as the reference clock signal, (B) a horizontal start signal based on at least one among the reference clock signal and the pixel clock signal, and (C) a synchronized serial digital image data signal based on the input serial digital image data signal and the pixel clock signal; and a signal line driver circuit for (A) converting the synchronized serial digital image data signal into a parallel digital image data signal corresponding to said signal lines, said parallel digital image data signal being in accordance with the pixel clock signal and the horizontal start signal and (B) providing an image signal to said signal lines, wherein said signal line driver circuit includes a duty ratio adjuster circuit which is located at an input of at least one among the synchronized serial digital image data signal, the pixel clock signal, and the horizontal start signal.

12. The display device according to claim 11, wherein said duty ratio adjuster circuit comprises a phase-locked loop circuit adjusting the duty ratio of the reference clock signal to substantially 50 percent (%).

13. The display device according to claim 12, wherein the frequency and phase of an output of said duty ratio adjuster circuit are substantially equal to the frequency and phase of an input of said duty ratio adjuster circuit.

14. The display device according to claim 11, wherein the frequency and phase of an output of said duty ratio adjuster circuit are substantially equal to the frequency and phase of an input of said duty ratio adjuster circuit.

15. The display device according to claim 11, wherein the ratio of the frequency of an input of said duty ratio adjuster circuit to the frequency of an output of said duty ratio adjuster circuit is substantially unity.

16. A display device comprising:

a display panel having a plurality of display picture elements electrically connected to a plurality of signal lines;

a control circuit for receiving a reference clock signal and a serial digital image data signal and generating (A) a pixel clock signal based on at least the reference clock signal and having the same frequency as the reference clock signal, (B) a horizontal start signal based on at least one among the reference clock signal and the pixel clock signal, and (C) a synchronized serial digital image data signal based on the input serial digital image data signal and the pixel clock signal, said control circuit comprising 1) a plurality of latch circuits, said plurality of latch circuits being connected in series and transferring the input serial digital image data signal so as to synchronize the input serial digital image data signal to the pixel clock signal, and 2) a first duty ratio adjuster circuit for adjusting a duty ratio of the reference clock signal and outputting the pixel clock signal; and a signal line driver circuit for (A) converting the synchronized serial digital image data signal into a parallel digital image data signal corresponding to said signal lines, said parallel digital image data signal being in accordance with the pixel clock signal and the horizontal start signal and (B) providing an image signal to said signal lines;

wherein said signal line driver circuit includes a second duty ratio adjuster circuit which is located at an input of at least one among the synchronized serial digital image data signal, the pixel clock signal, and the horizontal start signal.

17. The display device according to claim 16, wherein said first duty ratio adjusting circuit comprises a phase-locked loop circuit adjusting the duty ratio of the reference clock signal to substantially 50 percent (%).

18. The display device according to claim 17, wherein said second duty ratio adjusting circuit comprises a phase-locked loop circuit adjusting the duty ratio of the pixel clock signal to substantially 50 percent (%).

19. The display device according to claim 8, wherein the frequency and phase of an output of said first duty adjuster circuit is substantially the same as the frequency and phase of an input of said first duty adjuster circuit, and the frequency and phase of an output of said second duty adjuster circuit is substantially the same as the frequency and phase of an input of said second duty adjuster circuit.

20. The display device according to claim 18, wherein the ratio of the frequency of an input of said first duty ratio adjuster circuit to the frequency of an output of said first duty ratio adjuster circuit is substantially unity, and the ratio of the frequency of an input of said second duty ratio adjuster circuit to the frequency of an output of said second duty ratio adjuster circuit is substantially unity.

21. The display device according to claim 16, wherein said second duty ratio adjusting circuit comprises a phase-locked loop circuit adjusting the duty ratio of the pixel clock signal to substantially 50 percent (%).

22. The display device according to claim 21, wherein said first duty ratio adjusting circuit comprises a phase-locked loop circuit adjusting the duty ratio of the reference clock signal to substantially 50 percent (%).

* * * * *